US006982622B2

(12) United States Patent
Takeyama et al.

(10) Patent No.: US 6,982,622 B2
(45) Date of Patent: Jan. 3, 2006

(54) IGNITION COIL DEVICE

(75) Inventors: Shouichi Takeyama, Hashima (JP); Kazuhide Kawai, Kariya (JP); Masahiko Aoyama, Kariya (JP)

(73) Assignee: Denso Corporation, (JP)

( * ) Notice: Subject to any disclaimer, the term of this patent is extended or adjusted under 35 U.S.C. 154(b) by 52 days.

(21) Appl. No.: 10/724,172

(22) Filed: Dec. 1, 2003

(65) Prior Publication Data

US 2004/0113735 A1 Jun. 17, 2004

(30) Foreign Application Priority Data

Dec. 5, 2002 (JP) ..... 2002-354113
Oct. 31, 2003 (JP) ..... 2003-373496

(51) Int. Cl.
*H01F 27/02* (2006.01)

(52) U.S. Cl. ..... 336/96

(58) Field of Classification Search ..... 336/90–96, 336/107, 192, 198; 123/634–635
See application file for complete search history.

(56) References Cited

U.S. PATENT DOCUMENTS 6,196,209 B1 * 3/2001 Shimada et al. ..... 123/634
6,417,752 B1 7/2002 Heritier-Best et al.
2001/0050606 A1 * 12/2001 Nakamura ..... 336/96

FOREIGN PATENT DOCUMENTS

JP 8-339928 12/1996

* cited by examiner

*Primary Examiner*—Tuyen T Nguyen
(74) *Attorney, Agent, or Firm*—Nixon & Vanderhye PC

(57) ABSTRACT

An ignition coil device is mounted in a plug hole member forming a plug hole with forming internal space with the plug hole member. The ignition coil device includes a primary spool, a primary coil wire that is wound around an outer surface of the primary spool. At least a given portion of the outer surface of the primary spool is formed of crystalline resin. Here, the given portion fluidly communicates with the internal space of the plug hole.

19 Claims, 4 Drawing Sheets

IGNITION COIL DEVICE

CROSS REFERENCE TO RELATED APPLICATIONS

This application is based on and incorporates herein by reference Japanese Patent Applications No. 2002-354113 filed on Dec. 5, 2002 and No. 2003-373496 filed on Oct. 31, 2003.

FIELD OF THE INVENTION

The present invention relates to an ignition coil device. Specifically, it relates to a stick-type ignition coil device, which is mounted in a plug hole of an engine, with having high environment resistance.

BACKGROUND OF THE INVENTION

U.S. Patent of U.S. Pat. No. 6,417,752 discloses a stick-type ignition coil device whose peripheral core is exposed to a plug hole. FIG. 4 shows an exploded perspective view of the coil ignition device 100. As shown in FIG. 4, the ignition coil device 100 includes a secondary spool 101, a primary spool 102, and a peripheral core 103. The ignition coil device 100 is inserted in a plug hole (not shown). The secondary spool 101 is cylindrical. A secondary coil wire (not shown) is wound around an outer surface of the secondary spool 101. The primary spool 102 is cylindrical. The primary spool 102 is disposed as surrounding the secondary coil wire. A primary coil wire (not shown) is wound around an outer surface of the primary spool 102. The peripheral core 103 is cylindrical with having a slit 104 longitudinally extending. The peripheral core 103 is disposed as surrounding the primary coil wire with being exposed within the plug hole.

Non-crystalline resin such as PPE (Polyphenylene ether) sometimes develops cracks due to an even slight stress after contacting given gas, liquid, or solid. It is because developing of structure change such as breakage or cross bridging of molecular chains results in lowering strength. These phenomena are called ESC (environment stress crack). An instance of combinations of substances developing ESC is a combination of non-crystalline resin and blowby gas that is mixed gas including combustion gas, non-combustion gas, and atomized engine oil from an engine combustion chamber.

In the plug hole, the blowby gas flows from the engine combustion chamber through a plug insertion hole disposed in the bottom of the plug hole. In the ignition plug device 100, the primary spool 102 is exposed to the blowby gas that flows in through the slit 104 of the peripheral core 103 and then space between turns of the primary coil wire.

The primary spool 102 is generally formed of non-crystalline resin that has high adhesiveness to epoxy resin (not shown) filled in the ignition coil device 100. Furthermore, linear expansion coefficients of the primary spool 102 and members around the primary spool 102 are different. The primary spool 102 thereby suffers thermal stress due to heating/cooling cycles of an engine.

Thus, the primary spool 102 exposed to the blowby gas for a long time frame suffers the thermal stress, so that the primary spool 102 has possibility of developing the ESC. As a result, the ignition coil device 100 has poor environment resistance.

SUMMARY OF THE INVENTION

It is an object of the present invention to provide a ignition coil device having a primary spool that has high environment resistance.

In order to achieve the above and other objects, an ignition coil device is provided with the following. An ignition coil device is mounted in a plug hole member while forming internal space with the plug hole member. A primary spool and a primary coil wire are included. The primary coil wire is wound around an outer surface of the primary spool. At least a given portion of the outer surface of the primary spool is formed of crystalline resin. Here, the given portion fluidly communicates with the internal space.

The crystalline resin has superiority in heat resistance, chemical resistance, dimensional stability, mechanical strength in comparison with non-crystalline resin. Accordingly, even when thermal stress is applied after long hour exposure to blowby gas, i.e., under a condition where heat, blowby gas, and thermal stress work as composite, the crystalline resin that has superior characteristics can be relatively stable. The crystalline resin has thereby preferable blowby gas resistance. The ignition coil device has little possibility of developing environment stress cracks (ESC) due to the blowby gas and thermal stress. Accordingly, the ignition coil device that has the above structure has high environment resistance. This results in enhancing reliability of the ignition coil device itself.

In another aspect of the present invention, an ignition coil device mounted in a plug hole member is provided with the following. A secondary spool and a secondary coil wire are included. The secondary coil wire is wound around an outer surface of the secondary spool. A high voltage tower is included as being disposed closer, than the secondary spool, to a bottom of the plug hole member and as covering a bottom of the secondary spool. Here, a linear expansion coefficient of resin of which the secondary spool is formed is larger than that of the high voltage tower.

In this structure, the secondary spool thereby thermally expands more than the high voltage tower when the ignition coil device is heated up. The secondary spool that is disposed inside thereby contacts, under pressure, the high voltage tower that is disposed outside. This results in enhancing a sealing characteristic between the secondary spool and the high voltage tower. This also results in restricting development of ESC in members forming the ignition coil device. When a resin-made insulator such as epoxy is filled in, sealing to a secondary spool or other members can be enhanced.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS (First Embodiment)

Figure 1:
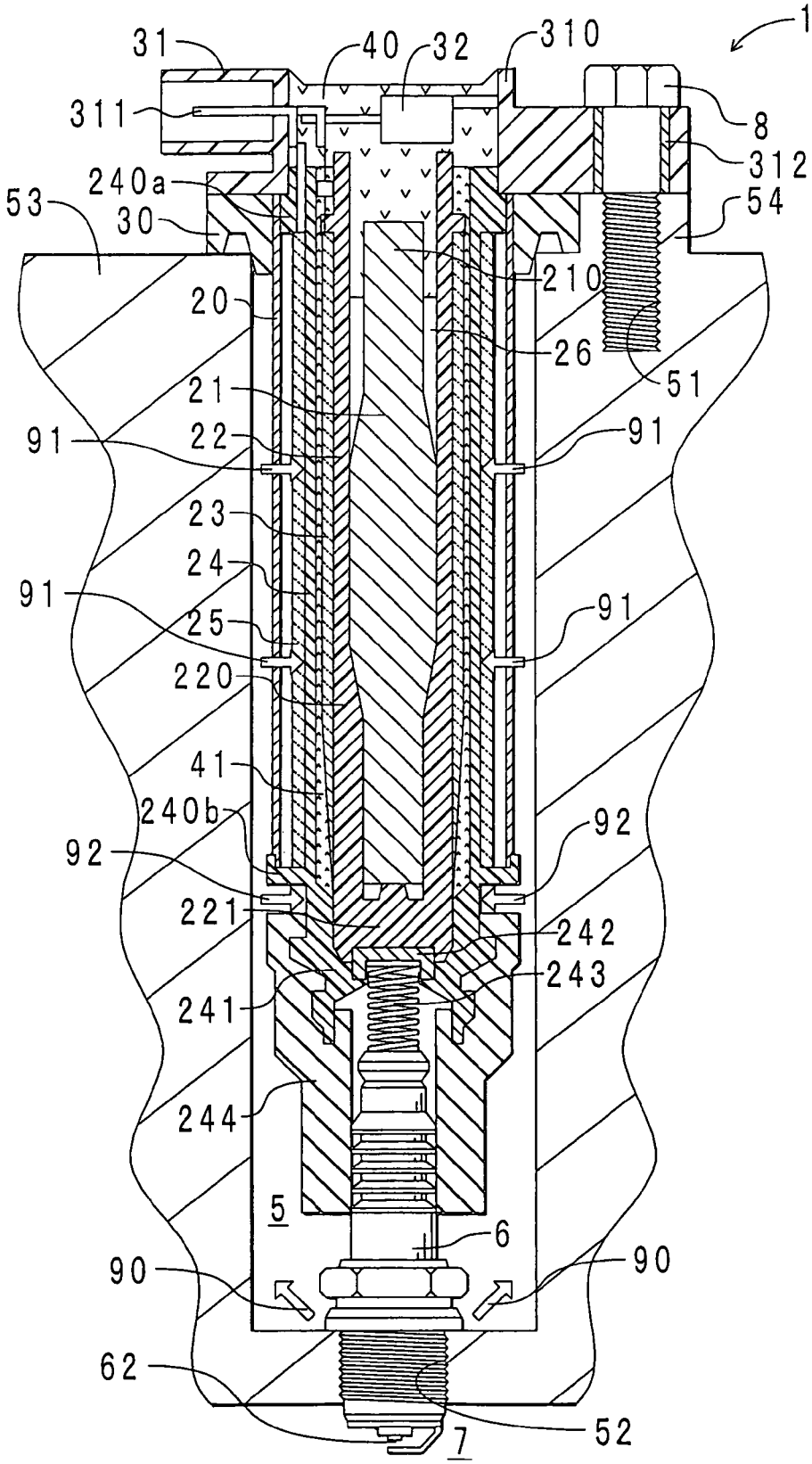
FIG. 1 is an axial sectional view of an ignition coil device according to a first embodiment of the present invention.

A structure of an ignition coil device 1 according to a first embodiment will be described with reference to FIG. 1. FIG. 1 shows an axial sectional view of the ignition coil device 1. A so-called stick-type ignition coil device 1 is housed (or mounted) in a plug hole member forming a plug hole 5 that is formed in each cylinder at the top of an engine block 53. Here, the ignition coil device 1 forms internal space with the plug hole member. Namely, the internal space being a subset of the plug hole 5 is space between the plug hole member and an outer surface of the ignition coil device 1. As will be discussed below, the ignition coil device 1 is connected to an ignition plug 6 at a lower portion in the drawing.

A peripheral core 20 is cylindrical and formed of a single sheet of silicon steel with having a slit (not shown) extending longitudinally. The peripheral core 20 surrounds a central core 21, a secondary spool 22, a secondary coil wire 23, a primary spool 24, and a primary coil wire 25.

The central core 21 is formed with compression molding where magnetic material particles inserted in a core mold is molded under given temperature and pressure. The central core 21 is formed like a round bar whose longitudinally centered portion has a broadened diameter.

The secondary spool 22 is formed of resin and is formed like a cylinder having a base. The secondary spool 22 is disposed as surrounding the central core 21. The secondary spool 22 includes a secondary spool body 220 and a base 221. The secondary spool body 220 is cylindrical. A lower portion from a longitudinal center to a longitudinal bottom end of the body 220 is shaped as being mating with a lower portion from a longitudinal center to a longitudinal bottom end of the central core 21 that the body 220 faces. The lower portion from the center of an outer surface of the central core 21 is thereby supported by contacting an inner surface of the secondary spool body 220. The base 221 occludes a bottom opening of the secondary spool body 220. The base 221 is shaped like a convexity. A bottom portion of the central core 21 is supported by the base 221. A cylindrical space 26 is partitioned between an upper portion of the outer surface of the central core 21 and an upper portion of the inner surface of the secondary spool body 220. The secondary coil wire 23 is wound around the outer surface of the secondary spool body 220.

The primary spool 24 is a cylinder formed of PPS (polyphenylene sulfide). The primary spool 24 is disposed as surrounding the secondary coil wire 23. The primary spool 24 is integrated with a high voltage tower 241 to be described later. Namely, the high voltage tower 241 is also formed of PPS. Around the outer surface of the primary spool 24, an upper flange 240*a* and a lower flange 240*b* are disposed with mutually having an axially-directional distance. The primary coil wire 25 is wound around the outer surface of the primary spool 24 between the upper and lower flanges 240*a*, 240*b*.

The high voltage tower 241 covers the base 221 of the secondary spool 22. A linear expansion coefficient of PPS of which the high voltage tower 241 is formed is designed as being lower than that of resin of which the base 221 is formed. The high voltage tower 241 is connected, around its center, with a high voltage terminal 241. The high voltage terminal 241 is formed of metal and like a cup. The high voltage terminal 241 downwardly opens. The high voltage terminal 242 is electrically connected with the secondary coil wire 23. A top end of a metal-made coil spring 243 is attached on a cup-bottom wall of the high voltage tower 242. A top end of an ignition plug 6 is elastically attached on a lower end of the coil spring 243. A rubber-made plug cap 244 covers an almost entire surface of the high voltage tower 241. An upper portion of the ignition plug 6 is press-inserted into an inner surface of the plug cap 244. A lower portion of the ignition plug 6 screws in a plug insertion hole 52 that is bored in the bottom of the plug hole 5. A gap 62 of a lower end of the ignition plug 6 protrudes within a combustion chamber 7.

A rubber-made seal ring 30 is inset at the top end of the peripheral core 20. The seal ring 30 is elastically attached around an opening brim of the plug hole 5. A connector section 31 is disposed over the seal ring 30.

The connector section 31 includes a case 310 and plural connector pins 311. The case 310 is resin-made and shaped like a center-hollow prism. An igniter 32 is disposed within the case 310. The igniter 32 is formed by sealing a power transistor (not shown), a hybrid integrated circuit (not shown), and a heatsink (not shown) with molding resin. A cylindrical metal-made collar 312 is formed by being inserted around a side portion of the case 312. A lower end of the collar 312 contacts an upper surface of a boss portion 54 that is disposed as protruding from an engine block 53. A bolt supporting hole 51 is bored around a central part of the boss portion 54. A metal-made bolt 8 screws in the bolt supporting hole 51 through the collar 312. Namely, the bolt 8 fixes the ignition coil device 1 in the plug hole 5.

The connector pins 311 are metal-made and shaped like strips. The connector pins 311 are molded by being inserted into the case 310. The connector pins 311 penetrate through the case 310 between an inner side and an outer side. Inner-side ends of the connector pins 311 are electrically connected with the igniter 32, the primary coil wire 25, and the secondary coil wire 23. By contrast, outer-side ends of the connector pins 311 are electrically connected with an ECU (engine control unit, not shown).

Within the ignition coil device 1, two types of resin-made insulators 40, 41 are used. The first insulator 40 is formed of epoxy resin and filled within the case 310 for supporting an upper end 210 of the central core 21. The first insulator 40 occludes an upper portion of the space 26. The second insulator 41 is filled between the outer surface of the secondary spool 22 and the inner surface of the primary spool 24 with penetrating between turns of the secondary coil wire 23.

In the next place, operation of the ignition coil device 1 according to the first embodiment will be explained below. A control signal from the ECU is sent to the igniter 32 through the connector pins 311. The igniter 32 turns on and off an electric current, so that given voltage is generated in the primary coil wire 25 due to self-induction. The generated voltage is amplified through mutual-induction between the primary coil wire 25 and the secondary coil wire 23. The amplified high voltage is sent to the ignition plug 6 through the secondary coil wire 23, the high voltage terminal 242, and the coil spring 243. The amplified high voltage thereby generates sparks in the gap 62.

In the next place, an assembling method of the ignition coil device 1 according to the first embodiment will be explained below. Solid components are at first assembled. The solid components are as follows: the central core 21, the secondary spool 22 where the secondary coil wire 23 is previously wound; the primary spool 24 and high voltage tower 241 where the primary coil wire 25 is previously wound; the connector section 31; and the like. Thereafter, the second insulator 41 is filled between the outer surface of the secondary spool 22 and the inner surface of the primary spool 24 from an opening of the upper end of the case 310. The first insulator 40 is then filled within the case 310. Here, the first insulator has relatively high kinetic viscosity, so that the fluidity of the first insulator 40 is relatively low during the filling. The first insulator 40 therefore has little possibility of entering the space 26. Thereafter, the ignition coil device 1 where the first and second insulators are already filled is heated under a given temperature for a given period to thermally harden the resin-made insulators 40, 41. Thus, the ignition coil device 1 is assembled.

In the next place, functions and effects of the ignition coil device 1 will be explained below. The blowby gas generated from the combustion chamber 7 flows in the plug hole 5 through space between an outer surface of a lower portion of the ignition plug 6 and an inner surface of the plug insertion hole 52 as shown in arrows 90. The blowby gas then flows within the ignition coil device 1 through the slit of the peripheral core 20. The blowby gas then flows to contact the primary spool 24 through space between turns of the primary coil wire 25 as shown in arrows 91.

Furthermore, the blowby gas that flows within the ignition coil device 1 directly contacts the upper portion of the high voltage tower 241 as shown in arrows 92 along with the lower flange 240*b* of the primary spool 24.

Here, if the primary spool 24 and the high voltage tower 241 are formed of non-crystalline resin, the both have possibility of developing the ESC due to the blowby gas and thermal stress acting on the both. However, the both of the ignition coil device 1 according to the first embodiment of the present invention are formed of the crystalline resin of PPS, so that the both have little possibility of developing the ESC due to the blowby gas and thermal stress acting on the both. Accordingly, the primary spool 24 and the high voltage tower 241 according to the first embodiment of the present invention has high environment resistance, which results in enhancing reliability of the ignition coil device 1 itself.

In the above embodiment, the primary spool 24 and the high voltage tower 241 are entirely formed of PPS and are integrated with each other. In comparison with a device where the both are separately provided, the number of components of the ignition coil device 1 thereby is small. This results in reducing the number of processes for assembling. the ignition coil device 1.

Furthermore, PPS has high insulation performance and high heat resistance, so that the ignition coil device 1 that uses PPS as the crystalline resin has little possibility of developing dielectric breakdown.

Incidentally, corona discharge sometimes occurs between the secondary coil wire 23 and the primary coil wire 25. Here, the primary spool 24 is disposed between the secondary and primary coil wires 23, 25. The primary spool 24 is thereby attacked by the corona discharge. Electrons collision energy derived from the attack of the corona discharge cuts molecular chains of the resin of the primary spool 24 which the electrons collide with. In addition, the collision energy is converted to thermal energy in the collision region of the resin. The collision region of the resin is thereby heated. Furthermore, oxygen within air close to the collision region ionizes. Ozone is thereby generated to oxidize the resin forming the collision region. In this respect, PPS used for the primary spool 24 has relatively strong bonding of the molecular chains, high heat resistance due to a high melting point, and also high ozone resistance. PPS thereby has high damage resistance, i.e., corona discharge resistance. Damage, due to the corona discharge, of the primary spool 24 in the ignition coil device 1 according to the first embodiment can be restricted.

Furthermore, PPS has enough fluidity during the molding to have less warpage after molding. Therefore, if a primary spool is formed through potting, operability in the potting can be enhanced. Accuracy of molding is additionally improved. Furthermore, PPS is not so hydrolyzed. That is, PPS has high hydrolysis resistance. As a result, an ignition coil device 1 according to the embodiment has high durability to moisture within a plug hole 5.

Furthermore, in the above embodiment, a linear expansion coefficient of the resin of which the base 221 of the secondary spool 22 is formed is larger than that of the resin of PPS of which the high voltage tower 241 is formed. The base 221 thereby thermally expands more than the high voltage tower 241 when the ignition coil device 1 is heated up. The secondary spool 22 that is disposed inside thereby contacts, under pressure, the high voltage tower 241 that is disposed outside. This results in enhancing a sealing characteristic between the base 221 and the high voltage tower 241. This also results in restricting development of the ESC in members forming the ignition coil device 1. When a resin-made insulator such as epoxy is filled in, sealing to a primary spool or a secondary spool can be enhanced.

(Second Embodiment)

Difference between the first embodiment and a second embodiment is that a primary spool and a high voltage tower are formed by potting and that no high voltage terminal is provided. Only the difference will be explained below.

Figure 2:
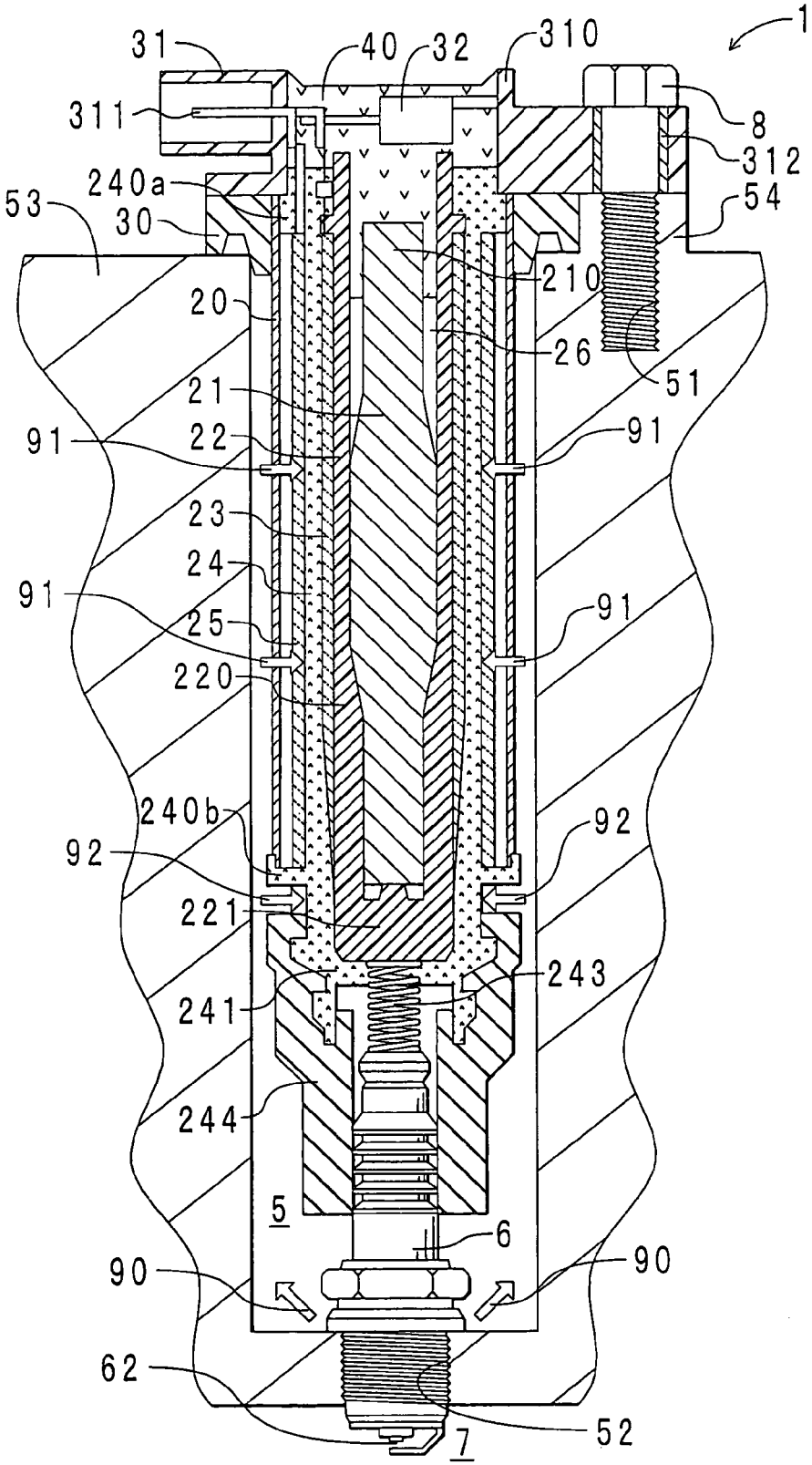
FIG. 2 is an axial sectional view of an ignition coil device according to a second embodiment of the present invention.

FIG. 2 is an axial sectional view of an ignition coil device 1 according to the second embodiment. Parts corresponding to that of the first embodiment use the same indicating numbers as in the first embodiment. A primary spool 24 and a high voltage tower 241 are formed by filling SPS (syndiotactic polystyrene) along an outer surface of a secondary spool 22 to harden it, i.e., by potting. In detail, a coil spring 243, a central core 21, and the secondary spool 22 where a second coil wire 23 is wound are disposed within dividable molds that mate with the primary spool 24 and the high voltage tower 241. Here, the secondary coil wire 23 and the coil spring 243 are previously electrically connected with each other. Thereafter, SPS is filled within the dividable molds to be then heated under a given temperature for a given period. The dividable molds are then cooled down to be divided. A primary coil wire 25, a plug cap 244, a peripheral core 20, a connector section 31, and the like are assembled. At last, a first insulator 40 is filled in from an opening of the upper end of a case 310.

In the above embodiment, the primary spool 24 and the high voltage tower 241 are entirely integrated with each other including a portion corresponding to the second insulator 41 shown in FIG. 1. The number of components of the ignition coil device 1 thereby becomes small. The high voltage terminal 242 shown in FIG. 1 is not disposed, so that the secondary coil wire 23 is directly connected with the coil spring 243. In this respect, the number of components is also reduced.

Furthermore, SPS used as the crystalline resin has high heat resistance, high dielectric breakdown resistance, high tracking resistance. SPS also has high fluidity during the potting and small warpage posterior to molding. This results in increasing operability of the potting. Molding accuracy for the primary spool 24 and the high voltage tower 241 is high.

(Third Embodiment)

Difference between the first embodiment and a third embodiment is that a primary spool and a high voltage tower are provided as separated independent members and that the high voltage tower is not exposed to a plug hole. Only the difference will be explained below.

Figure 3:
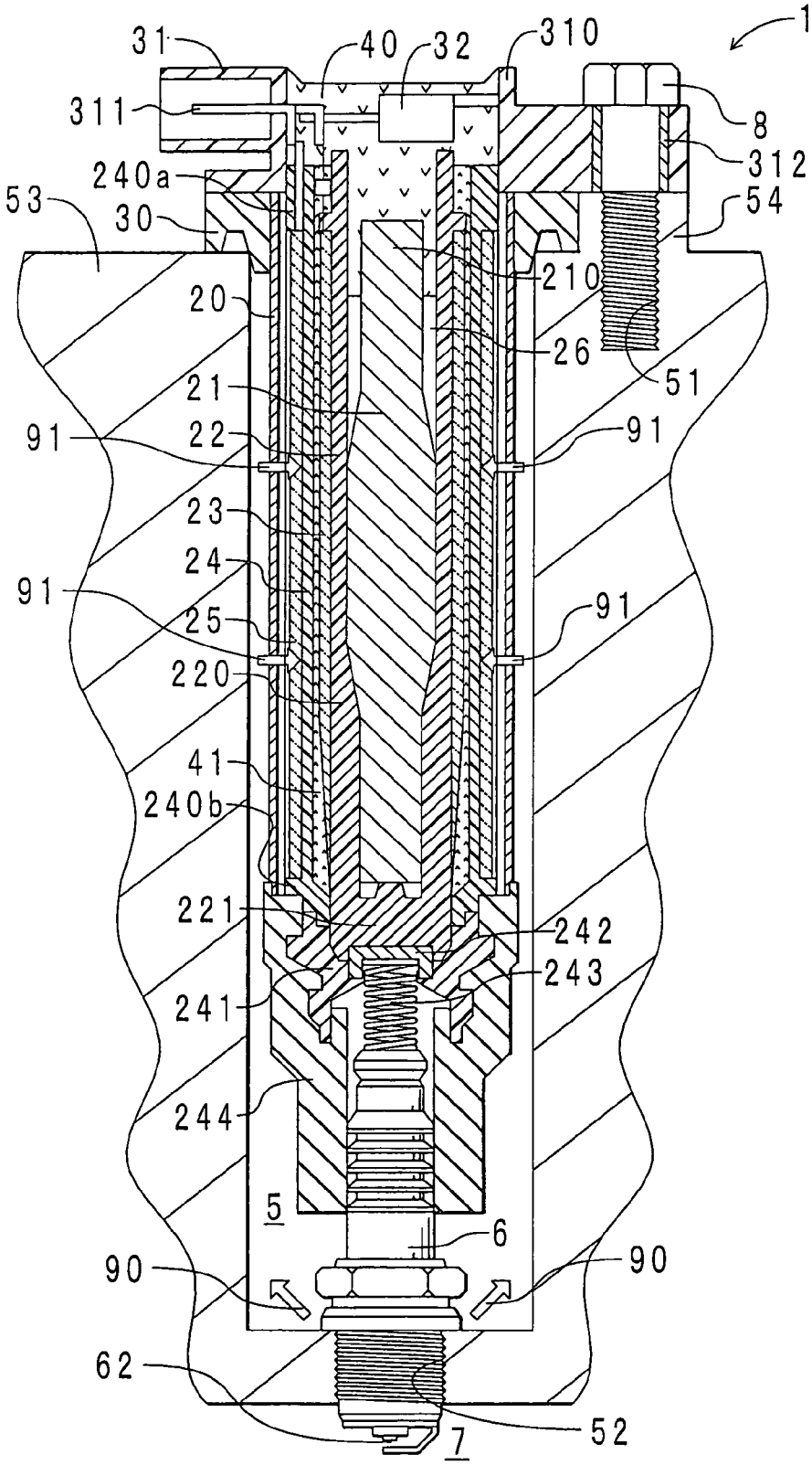
FIG. 3 is an axial sectional view of an ignition coil device according to a third embodiment of the present invention.
Figure 4:
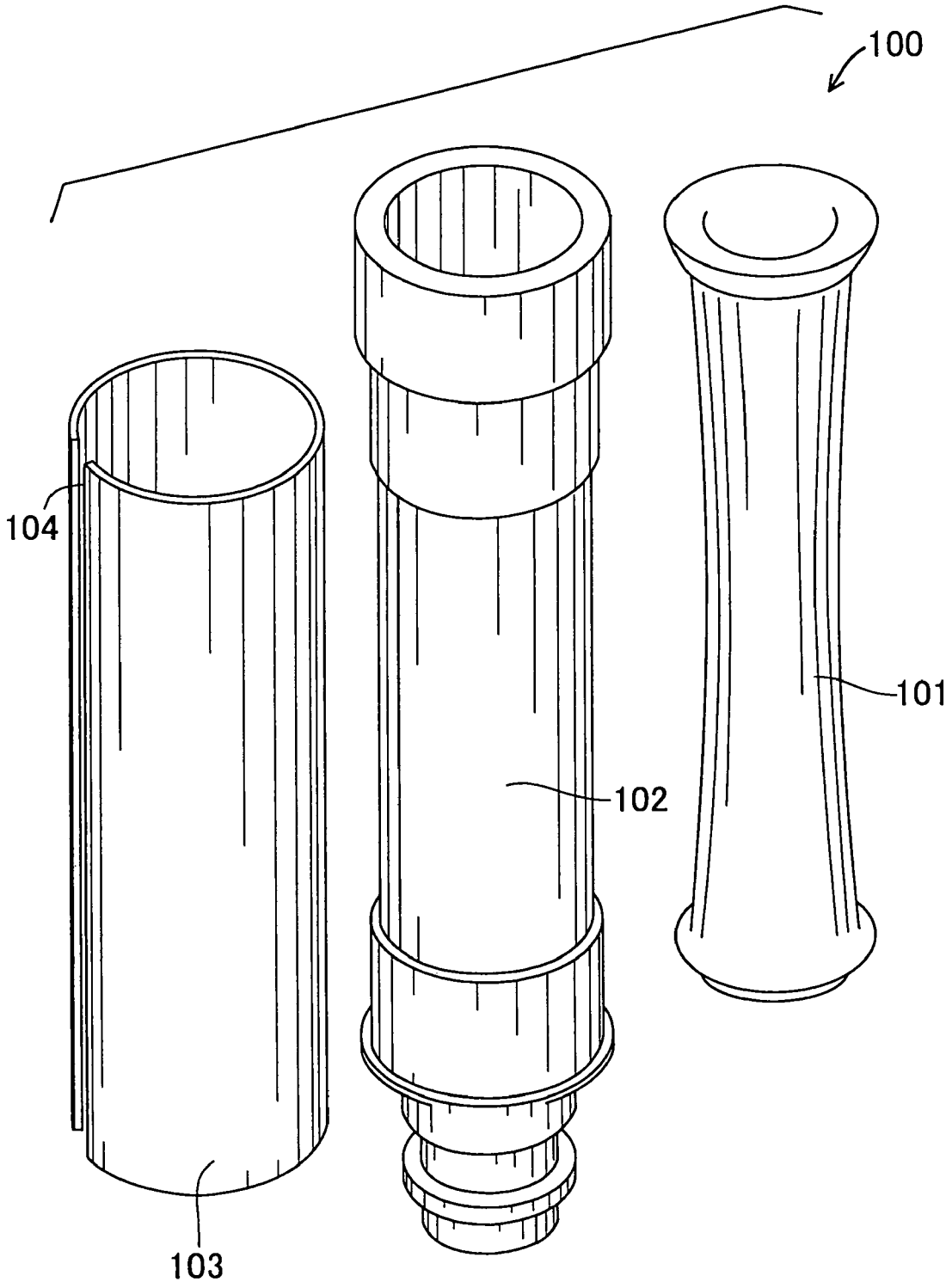
FIG. 4 RELATED ART
FIG. 4 is an exploded perspective view of an ignition coil device of a related art.

FIG. 3 is an axial sectional view of an ignition coil device 1 according to the third embodiment. Parts corresponding to that of the first embodiment use the same indicating numbers as in the first embodiment. A primary spool 24 and a high voltage tower 241 are provided as separated independent members with being axially mated with each other. The primary spool 24 is formed of SPS (syndiotactic polystyrene), while the high voltage tower 241 is formed of PPE (polyphenylene ether). The primary spool 24 contacts the blowby gas as shown in arrows 91 in FIG. 3. The primary spool 24 is thereby formed of crystalline resin of SPS. By contrast, the high voltage tower 241 does not contact the blowby gas, so that it does not need to be formed of crystalline resin. The high voltage tower 241 is formed of PPE that is non-crystalline resin and much adherent to the second insulator 41.

In the above embodiment, in comparison with a device where the primary spool 24 and the high voltage tower 241 are formed of SPS as being integrated with each other, expensive SPS can be decreased in production. The production cost of the ignition coil device 1 according to the third embodiment thereby becomes low. Since the high voltage tower 241 is formed of PPE that is much adherent to the second insulator 41, the high voltage tower 241 and the second insulator 41 are seldom separated from each other.

(Other)

Explanation regarding crystalline resin will be added below. The crystalline resin has crystalline region whose polymer chains are regularly arranged under the melting point. With having the more crystalline region, the crystalline resin has superiority in heat resistance, chemical resistance, dimensional stability, and mechanical strength in comparison with non-crystalline resin. Accordingly, even when thermal stress is applied after long hour exposure to the blowby gas, i.e., under a condition where heat, blowby gas, and thermal stress work as composite, the crystalline resin that has superior characteristics can be relatively stable. As a result, the crystalline resin has preferable blowby gas resistance. An ignition coil device 1 according to the embodiments has thereby less possibility of dielectric breakdown.

Here, a crystallinity degree of the crystalline resin is preferably set between 20% and 80%. With the crystallinity degree of less than 20%, the crystalline resin does not properly show superiority in heat resistance, chemical resistance, dimensional stability, or mechanical strength. With the crystallinity degree of more than 80%, the crystalline resin is too much hardened, which results in lowering workability. Furthermore, a crystallinity degree of the crystalline resin is more preferably set between 30% and 80% with regard to ESC resistance.

A crystallinity degree (X %) of the crystalline resin is obtain from a formula as follows.

$$X=((\Delta H_{Tm}-\Delta H_{Tcc})/(\Delta H_0\times W))\times 100$$

Here, $\Delta H_{Tm}$ is melting heat (J/g) at melting point Tm, $\Delta H_{Tcc}$ is a peak value (J/g) at re-crystalline temperature Tcc, $\Delta H_0$ is melting heat (J/g) at a crystallinity degree of 100% of a crystalline resin, and W is % by weight of a crystalline resin.

These parameters can be measured with a DSC (differential scanning calorimeter). In detail, $\Delta H_{Tm}$ is measured as dimensions of an endothermal reaction peak. $\Delta H_{Tcc}$ is measured as dimensions of an exothermal reaction peak. $\Delta H_0$ can be obtained from a reference. W is obtained by dividing crystalline resin weight as a measurement target within a specimen by entire specimen weight.

(Modification)

Although an ignition coil device of the present invention is explained above, it is not limited to the above embodiments.

For instance, in the third embodiment, although the primary spool 24 is entirely formed of SPS, the primary spool 24 can be structured as a spool body formed of non-crystalline resin and an SPS-made protection tape. The SPS-made protection tape can be wound, between an upper flange 240*a* and a lower flange 240*b*, around the spool body which the blowby gas contacts. The conventional spool formed of non-crystalline resin can be used in an embodiment of the present invention.

Similarly, the high voltage tower can be also structured as a high voltage tower body formed of non-crystalline resin and an SPS-made protection tape. The SPS-made protection tape can be wound, around a portion of the high voltage tower body which the blowby gas contacts. The conventional high voltage tower formed of non-crystalline resin can be also used in an embodiment of the present invention.

Crystalline resin such as SPS can be used not only as a tape but also a film. Furthermore, crystalline resin can be applied as an embrocation on a spool body or a high voltage tower body.

As the crystalline resin, not only PPS or SPS, but also PBT (polybutylene terephthalate) or PET (polyethylene terephthalate) can be used. Here, PBT or PET is relatively low in price. Furthermore, a primary spool and a high voltage tower can be formed of different crystalline resin types, respectively.

It will be obvious to those skilled in the art that various changes may be made in the above-described embodiments of the present invention. However, the scope of the present invention should be determined by the following claims.

What is claimed is:

1. An ignition coil device mounted in a plug hole of a plug hole member, an internal space being defined between the ignition coil device and a wall of the plug hole, the ignition coil device comprising:

a primary spool;

a primary coil wire that is wound around an outer surface of the primary spool; and a peripheral core that surrounds the primary coil wire with an interval gap defined between an inner surface of the peripheral core and an outer surface of the turns of the primary coil wire, wherein an outer surface of the peripheral core is exposed towards the internal space, wherein a gas path is provided through the peripheral core for gas to flow between the outer surface of the peripheral core and the inner surface of the peripheral core, and wherein at least a given portion of the outer surface of the primary spool is formed of crystalline resin, and wherein gas is able to reach the given portion from the internal space via the gas path, the interval gap, and spaces between turns of the primary coil wire.

2. The ignition coil device of claim 1, wherein the primary spool is formed of the crystalline resin.

3. The ignition coil device of claim 1,
wherein the crystalline resin includes at least one of PPS, PBT SPS, and PET.

4. The ignition coil device of claim 3,
wherein the crystalline resin is PPS and the primary spool is formed of the PPS.

5. The ignition coil device of claim 3,
wherein the crystalline resin is PBT.

6. The ignition coil device of claim 3,
wherein the crystalline resin is SPS and the primary spool is formed of the SPS.

7. The ignition coil device of claim 3,
wherein the crystalline resin is PET.

8. The ignition coil device of claim 1,
wherein the crystalline resin has a crystallinity degree between 20% and 80%.

9. The ignition coil device of claim 1,
wherein the crystalline resin has a crystallinity degree between 30% and 80%.

10. The ignition coil device of claim 1, further comprising:
a high voltage tower provided closer, than the primary spool, to a bottom of the plug hole,
wherein at least a certain portion of a surface of the high voltage tower is formed of the crystalline resin, wherein the certain portion fluidly communicates with the internal space.

11. The ignition coil device of claim 10,
wherein the high voltage tower is formed of the crystalline resin.

12. The ignition coil device of claim 10,
wherein the high voltage tower is integrally formed in one piece with the primary spool.

13. An ignition coil device mounted in a plug hole member, comprising:
a secondary spool;
a secondary coil wire that is wound around an outer surface of the secondary spool; and
a high voltage tower provided closer, than the secondary spool, to a bottom of the plug hole member, wherein the high voltage tower covers and contacts a bottom of the secondary spool,
wherein a linear expansion coefficient of resin of which the secondary spool is formed is larger than a linear expansion coefficient of resin of which the high voltage tower is formed so that, when the ignition coil device is heated up, the bottom of the secondary spool contacts the high voltage tower with expanding pressure to thereby increase a sealing characteristic between the bottom of the secondary spool and the high voltage tower.

14. The ignition coil device of claim 13, wherein the secondary spool includes a spool body and a base, the spool body being generally cylindrical having an upper portion and a lower portion adjacent said base, a wall thickness of said upper portion being less than a wall thickness of the lower portion, thereby to define a reduced interior dimension at said lower portion.

15. The ignition coil device of claim 13, wherein a central core is disposed in said secondary spool and includes a longitudinal center portion having a diameter greater than a diameter at a longitudinal end thereof.

16. The ignition coil device of claim 14, wherein a central core is disposed in said secondary spool and includes a longitudinal center portion having a diameter greater than a diameter at a longitudinal end thereof.

17. The ignition coil device of claim 16, wherein the center portion of the central core engages an inner surface of the secondary spool at a transition between said upper portion of said spool body and said lower portion of said spool body.

18. The ignition coil device of claim 17, wherein the center portion has a greater diameter than each longitudinal end thereof and a cylindrical space is defined between an upper portion of the center core and an inner surface of the upper portion of the secondary spool body.

19. The ignition coil device of claim 17, wherein the upper portion of the secondary spool body has an inner diameter substantially corresponding to an outer diameter of said center portion of the central core and an inner diameter of said secondary spool lower end generally corresponds to an outer diameter of the center core at said longitudinal end thereof.

* * * * *